US008447220B2

(12) United States Patent
Yamaguchi et al.

(10) Patent No.: US 8,447,220 B2
(45) Date of Patent: May 21, 2013

(54) FIXING DEVICE AND IMAGE FORMING APPARATUS INCLUDING SAME

(75) Inventors: Yoshiki Yamaguchi, Kanagawa (JP); Masaaki Yoshikawa, Tokyo (JP); Kenji Ishii, Kanagawa (JP); Naoki Iwaya, Tokyo (JP); Tetsuo Tokuda, Kanagawa (JP); Yutaka Ikebuchi, Kanagawa (JP); Takahiro Imada, Kanagawa (JP); Takamasa Hase, Kanagawa (JP); Toshihiko Shimokawa, Kanagawa (JP); Hiroshi Yoshinaga, Chiba (JP); Ippei Fujimoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 339 days.

(21) Appl. No.: 13/009,199

(22) Filed: Jan. 19, 2011

(65) Prior Publication Data

US 2011/0200368 A1 Aug. 18, 2011

(30) Foreign Application Priority Data

Feb. 12, 2010 (JP) ..... 2010-028912

(51) Int. Cl.
*G03G 15/20* (2006.01)

(52) U.S. Cl.
USPC ..... 399/329; 399/122

(58) Field of Classification Search
USPC .. 399/107, 110, 122, 320, 328–334; 219/216, 219/619
See application file for complete search history.

(56) References Cited

U.S. PATENT DOCUMENTS

| | | | | |
|---|---|---|---|---|
| 7,505,726 | B2 * | 3/2009 | Tokuhiro et al. | 399/329 |
| 7,962,082 | B2 * | 6/2011 | Takahashi et al. | 399/328 |
| 8,219,015 | B2 * | 7/2012 | Shinshi et al. | 399/329 |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |

FOREIGN PATENT DOCUMENTS

| | | |
|---|---|---|
| JP | 10-213984 | 8/1998 |
| JP | 2884714 | 2/1999 |
| JP | 3298354 | 4/2002 |
| JP | 3592485 | 9/2004 |
| JP | 2007-334205 | 12/2007 |

(Continued)

OTHER PUBLICATIONS

U.S. Appl. No. 12/964,090, filed Dec. 9, 2010, Iwaya, et al.

(Continued)

*Primary Examiner* — Hoan Tran
(74) *Attorney, Agent, or Firm* — Oblon, Spivak, McClelland, Maier & Neustadt, L.L.P.

(57) ABSTRACT

A fixing device includes a contact member provided inside a fixing member and pressed against a pressing member via the fixing member to form a nip between the pressing member and the fixing member through which a recording medium bearing atoner image passes. A sheet heat generator provided in the fixing member includes a flexible heat generation sheet contactable against the fixing member to heat the fixing member. A contact adjuster provided in the fixing member adjusts an area of contact of the heat generation sheet and the fixing member in the axial direction, supports the heat generation sheet at a first position at which the heat generation sheet contacts the fixing member, and bends a portion of the heat generation sheet at a second position to separate the heat generation sheet from the fixing member.

12 Claims, 9 Drawing Sheets

FOREIGN PATENT DOCUMENTS

| | | |
|---|---|---|
| JP | 2008-158482 | 7/2008 |
| JP | 2008-216928 | 9/2008 |
| JP | 2008-310051 | 12/2008 |

OTHER PUBLICATIONS

U.S. Appl. No. 12/926,661, filed Dec. 2, 2010.
U.S. Appl. No. 13/026,945, filed Feb. 14, 2001, Ishii, et al.
U.S. Appl. No. 12/805,818, filed Aug. 20, 2010.
U.S. Appl. No. 12/876,589, filed Sep. 7, 2010, Yoshiki Yamaguchi, et al.
U.S. Appl. No. 12/879,875, filed Sep. 10, 2010, Ippei Fujimoto, et al.
U.S. Appl. No. 12/852,079, filed Aug. 6, 2010, Akira Shinshi, et al.
U.S. Appl. No. 12/923,272, filed Sep. 13, 2010.
U.S. Appl. No. 12/881,862, filed Sep. 14, 2010, Takamasa Hase, et al.
U.S. Appl. No. 12/888,980, filed Sep. 23, 2010, Yoshiki Yamaguchi, et al.
U.S. Appl. No. 12/923,231, filed Sep. 10, 2010.
U.S. Appl. No. 12/923,176, filed Sep. 8, 2010.
U.S. Appl. No. 12/874,734, filed Sep. 2, 2010, Akira Shinshi, et al.
U.S. Appl. No. 12/861,255, filed Aug. 23, 2010, Satoshi Ueno, et al.
U.S. Appl. No. 12/881,547, filed Sep. 14, 2010, Naoki Iwaya, et al.
U.S. Appl. No. 12/849,404, filed Aug. 3, 2010, Toshihiko Shimokawa, et al.
U.S. Appl. No. 12/878,480, filed Sep. 9, 2010, Yoshiki Yamaguchi, et al.
U.S. Appl. No. 12/880,327, filed Sep. 13, 2010, Ryota Yamashina, et al.
U.S. Appl. No. 12/857,953, filed Aug. 17, 2010, Masaaki Yoshikawa, et al.
U.S. Appl. No. 12/893,361, filed Sep. 29, 2010, Kenichi Hasegawa, et al.
U.S. Appl. No. 12/878,557, filed Sep. 9, 2010, Akira Shinshi, et al.
U.S. Appl. No. 12/946,276, filed Nov. 15, 2010, Yoshiki Yamaguchi, et al.
U.S. Appl. No. 12/946,347, filed Nov. 15, 2010, Kenji Ishii, et al.
U.S. Appl. No. 12/841,593, filed Jul. 22, 2010, Masaaki Yoshikawa, et al.

* cited by examiner

FIG. 6A
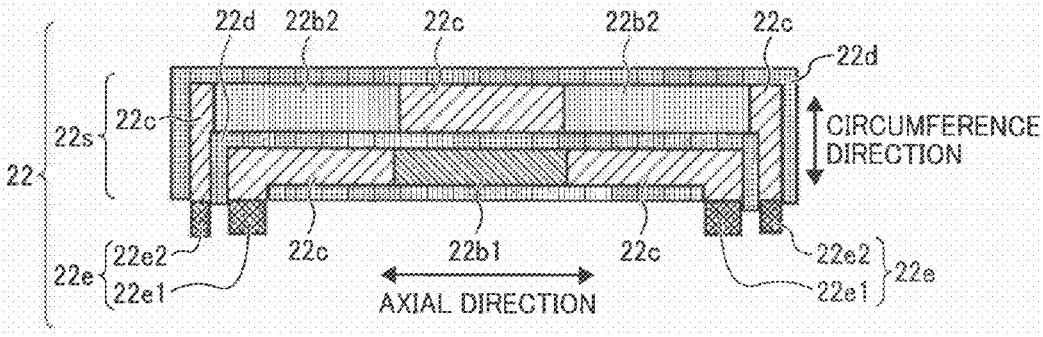
FIG. 6B
| | | |
|---|---|---|
| (2, 1) | (2, 2) | (2, 3) |
| (1, 1) | (1, 2) | (1, 3) |
FIG. 7
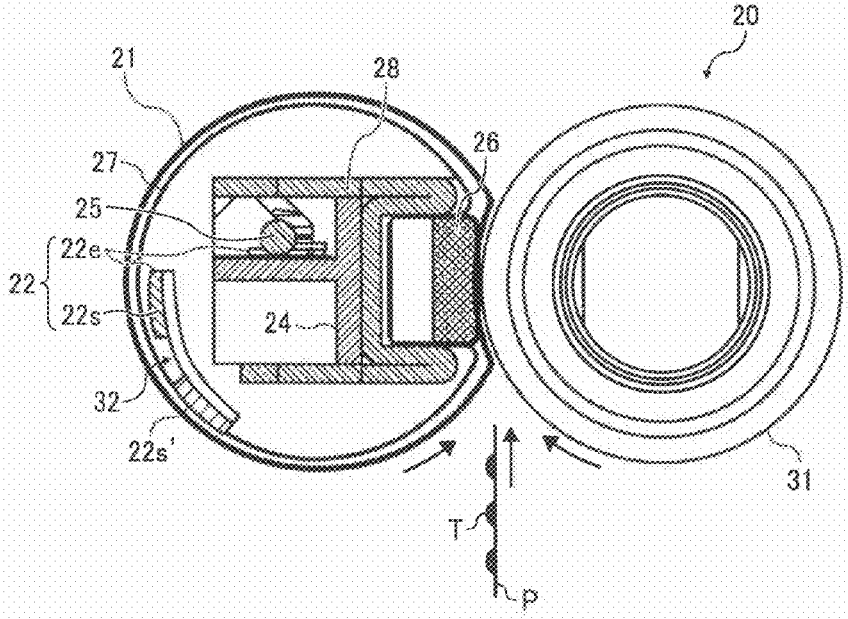

FIXING DEVICE AND IMAGE FORMING APPARATUS INCLUDING SAME

CROSS-REFERENCE TO RELATED APPLICATIONS

The present application is based on and claims priority to Japanese Patent Application No. 2010-028912, filed on Feb. 12, 2010 in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charging device uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such a fixing device may include an endless fixing belt serving as a fixing member formed into a loop, a heater provided inside the loop to heat the fixing belt, and a pressing roller pressing the fixing belt to form a fixing nip therebetween. As a recording medium passes through the fixing nip, the fixing member applies heat to the recording medium to melt the toner image and fix it onto the recording medium.

Generally, fixing devices need to accommodate different sizes of recording media sheets. For example, a recording medium having a width narrower than a heating area of the fixing member in the axial direction thereof may be fed to the fixing nip. In such a case, a portion of the fixing member, for example, end portions in the axial direction, which does not contact the recording medium, remains heated by the heating member, thereby getting overheated because there is no recording medium to draw heat from the fixing member at that portion.

In order to accommodate different sizes of recording media sheets, one related-art fixing device employs, for example, a heating roller including a plurality of heat sources having different distributions of heat generation in the width direction of a recording medium. The heat sources include, for example, a halogen heater, a sheet heat generating member, an electromagnetic induction heater, and so forth.

In this configuration, electric power is supplied only to the heat source(s) corresponding to the width of the recording medium, thereby heating only that portion of the heating roller corresponding to the width of the recording medium. Accordingly, the temperature of the end portion of the heating roller which the recording medium does not contact is prevented from getting overheated.

Although advantageous, a range of adjustment of the heating width is limited to the number of heat sources employed in the heating roller. In other words, the type of recording media sheets that the fixing device can accommodate depends on the number of the heat sources in the heating roller.

In view of the above, there is demand for a fixing device capable of accommodating different sizes of recording media sheets while at the same time preventing overheating of the fixing member.

BRIEF SUMMARY OF THE INVENTION

In view of the foregoing, in one illustrative embodiment of the present invention, a fixing device for fixing a toner image on a recording medium includes an endless belt-shaped fixing member, a pressing member, a contact member, a sheet heat generator, and a contact adjuster. The endless belt-shaped fixing member rotates in a predetermined direction of rotation and is formed in a loop. The pressing member contacts an outer circumferential surface of the fixing member. The contact member is provided inside the loop formed by the fixing member and pressed against the pressing member via the fixing member to form a nip between the pressing member and the fixing member through which the recording medium bearing the toner image passes. The sheet heat generator is provided inside the loop formed by the fixing member and includes a flexible heat generation sheet having a predetermined length in a circumferential direction of the fixing member and a width in an axial direction of the fixing member. The heat generation sheet is contactable against an inner circumferential surface of the fixing member to heat the fixing member. The contact adjuster is provided inside the loop formed by the fixing member to adjust an extent of contact of the heat generation sheet and the fixing member in the axial direction. The contact adjuster supports the heat generation sheet at a first position at which the heat generation sheet contacts the fixing member, and bends a portion of the heat generation sheet at a second position at which a portion of the heat generation sheet is separated from or contacts the fixing member.

In another illustrative embodiment of the present invention, an image forming apparatus includes the fixing device.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein:

FIG. 6A is a plan view of a sheet heat generator employed in the fixing device;

FIG. 6B is a lookup table of a matrix representing regions on the sheet heat generator shown in FIG. 6A;

FIG. 7 is a schematic cross-sectional view of the fixing device according to an illustrative embodiment of the present invention;

DETAILED DESCRIPTION OF THE INVENTION

Figure 1:
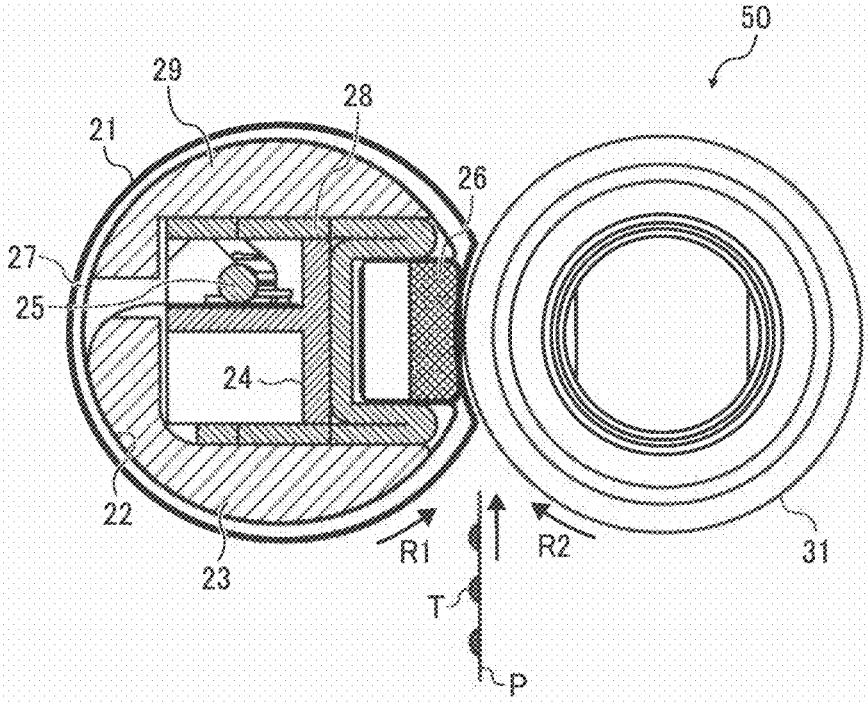
FIG. 1 is a schematic cross-sectional view of a basic structure of a fixing device employed in an image forming apparatus according to an exemplary embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, in particular to FIG. 1, a basic structure of a fixing device employed in an image forming apparatus according to an exemplary embodiment of the present invention is explained.

Referring now to FIG. 1, there is provided a schematic cross-sectional diagram illustrating the basic structure of the fixing device.

FIG. 1 illustrates a basic structure of a fixing device 50. As illustrated in FIG. 1, the fixing device 50 includes a fixing sleeve 21, a sheet heat generator 22, a heat generator support 23, a terminal stay 24, a power supply wire 25, a contact member 26, a pipe-shaped fixing member support 27, a substantially H-shaped core holder 28, and a heat insulation support 29. As illustrated in FIG. 1, the fixing sleeve 21 is a rotatable endless belt serving as a fixing member or a rotary fixing member. The pressing roller 31 serves as a pressing member or a rotary pressing member that contacts an outer circumferential surface of the fixing sleeve 21. The contact member 26 is provided inside a loop formed by the fixing sleeve 21, and is pressed against the pressing roller 31 through the fixing sleeve 21 to form a nip between the pressing roller 31 and the fixing sleeve 21 through which the recording medium passes.

The sheet heat generator 22 is provided also inside the loop formed by the fixing sleeve 21, and contacts or is disposed close to an inner circumferential surface of the fixing sleeve 21 to heat the fixing sleeve 21 directly or indirectly. The heat generator support 23 is provided inside the loop formed by the fixing sleeve 21 to support the sheet heat generator 22 at a predetermined position in such a manner that the heat generator support 23 and the fixing sleeve 21 sandwich the sheet heat generator 22.

According to the exemplary embodiment, the sheet heat generator 22 contacts the inner circumferential surface of the fixing sleeve 21 to heat the fixing sleeve 21 directly. The pipe-shaped fixing member support 27 is disposed inside the loop formed by the fixing sleeve 21 and supports the fixing sleeve 21 that rotates. The heat insulation support 29 is disposed downstream from the nip on the outer surface of the H-shaped core support 28 inside the pipe-shaped fixing member support 27.

Figure 2A:
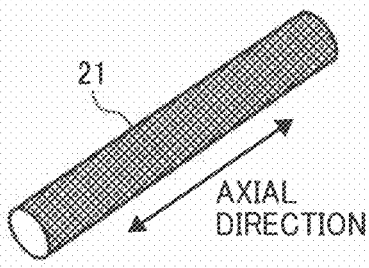
FIG. 2A is a perspective view of a fixing sleeve of the fixing device shown in FIG. 1.
Figure 2B:
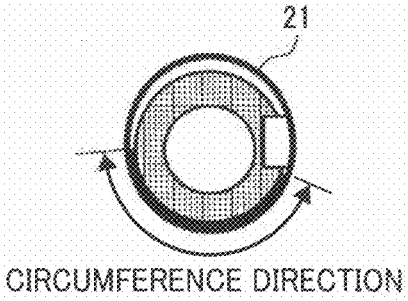
FIG. 2B is a schematic cross-sectional view of the fixing sleeve shown in FIG. 2A.

With reference to FIGS. 2A and 2B, a description is now provided of the fixing sleeve 21. FIG. 2A is a schematic perspective view of the fixing sleeve 21. FIG. 2B is a schematic cross-sectional view of FIG. 2B. As illustrated in FIG. 2A, an axial direction of the fixing sleeve 21 corresponds to a long axis of the pipe-shaped fixing sleeve 21.

As illustrated in FIG. 2B, a circumferential direction of the fixing sleeve 21 extends along a circumference of the pipe-shaped fixing sleeve 21. The fixing sleeve 21 is a flexible, pipe-shaped, endless belt having a width in the axial direction of the fixing sleeve 21 that corresponds to a width of a recording medium P passing through the nip defined by the fixing sleeve 21 and the pressing roller 31. The fixing sleeve 21 includes, for example, a base member on which at least a release layer is provided. The base member is made of a metal material and has a thickness in a range of from approximately 30 μm to 50 μm. The fixing sleeve 21 has an outer diameter of approximately 30 mm. The base member of the fixing sleeve 21 includes a conductive metal material such as iron, cobalt, nickel, or an alloy of those.

The release layer of the fixing sleeve 21 is a tube covering the base member, and has a thickness of approximately 50 μm. The release layer includes a fluorine compound such as tetrafluoroethylene-perfluoroalkylvinylether copolymer (PFA). The release layer facilitates separation of toner of a toner image T on the recording medium P, which contacts the outer circumferential surface of the fixing sleeve 21 directly, from the fixing sleeve 21.

The pressing roller 31 depicted in FIG. 1 is constructed of a metal core including a metal material such as aluminum or copper, on which are provided, in order, a heat-resistant elastic layer and a release layer. The heat-resistant elastic layer provided on the metal core includes silicon rubber (e.g., solid rubber). The release layer is provided on the elastic layer.

The pressing roller 31 has an outer diameter of approximately 30 mm. The elastic layer has a thickness in a range from approximately 2 mm to 3 mm. The release layer is a PFA tube covering the elastic layer and has a thickness of approximately 50 μm.

A heat generator, such as a halogen heater, may be provided inside the metal core of the pressing roller 31 as needed. A pressing mechanism, not illustrated, presses the pressing roller 31 against the contact member 26 via the fixing sleeve 21 to form the nip between the pressing roller 31 and the fixing sleeve 21. For example, a portion of the pressing roller 31 contacting the fixing sleeve 21 forms a concave portion of the fixing sleeve 21 at the nip. Thus, the recording medium P passing through the nip N moves along the concave portion of the fixing sleeve 21.

A driving mechanism, not illustrated, drives and rotates the pressing roller 31, which presses the fixing sleeve 21 against the contact member 26, in the clockwise direction in FIG. 1 in a rotation direction R2. Accordingly, the fixing sleeve 21 rotates counterclockwise in a rotation direction R1 in accordance with rotation of the pressing roller 31 in FIG. 1.

A long axis of the contact member 26 corresponds to the axial direction of the fixing sleeve 21. At least a portion of the contact member 26 that is pressed against the pressing roller 31 through the fixing sleeve 21 includes a heat-resistant elastic material such as fluorocarbon rubber. The core holder 28 holds and fixes the contact member 26 at a predetermined position inside the loop formed by the fixing sleeve 21. A portion of the contact member 26 that contacts the inner circumferential surface of the fixing sleeve 21 may include a slidable and durable material such as Teflon (registered trademark) sheet.

The core holder 28 is made of sheet metal, and has a width in a long axis thereof corresponding to the width of the fixing sleeve 21 in the axial direction of the fixing sleeve 21. The core holder 28 is a rigid member having an H-like shape in cross-section, and is provided substantially at a center inside the loop formed by the fixing sleeve 21.

The core holder 28 holds the respective components provided inside the loop formed by the fixing sleeve 21 at predetermined positions. For example, the core holder 28 includes a first concave portion facing the pressing roller 31, which houses and holds the contact member 26. In other words, the core holder 28 is disposed opposite the pressing roller 31 through the contact member 26 to support the contact member 26, with the fixing sleeve 21 disposed therebetween. Accordingly, even when the pressing roller 31 presses the fixing sleeve 21 against the contact member 26, the core holder 28 prevents substantial deformation of the contact member 26. In addition, the contact member 26 protrudes from the core holder 28 slightly toward the pressing roller 31. Accordingly, the core holder 28 is isolated from and does not contact the fixing sleeve 21 at the nip N.

The core holder 28 further includes a second concave portion disposed back-to-back to the first concave portion, which houses and holds the terminal stay 24 and the power supply wire 25. The terminal stay 24 has a width in a long axis thereof corresponding to the width of the fixing sleeve 21 in the axial direction of the fixing sleeve 21, and is T-shaped in cross-section. The power supply wire 25 extends on the terminal stay 24, and transmits power supplied from an outside of the fixing device 50. A part of an outer circumferential surface of the core holder 28 holds the heat generator support 23 that supports the sheet heat generator 22.

In FIG. 1, the core holder 28 holds the heat generator support 23 in a lower half region inside the loop formed by the fixing sleeve 21, that is, in a semicircular region provided upstream from the nip in the rotation direction R1 of the fixing sleeve 21. The heat generator support 23 may be adhered to the core holder 28 to facilitate assembly. Alternatively, the heat generator support 23 need not be adhered to the core holder 28 to prevent heat transmission from the heat generator support 23 to the core holder 28.

The fixing member support 27 includes end portions formed such that the circumferential surface of the pipe-shaped fixing member support 27 is cut in the axial direction. The core holder 28 holds the respective end portions of the fixing member support 27 at the front and the back of the nip in the circumferential direction. It is to be noted that end portions of the fixing member support 27 in the axial direction thereof are held by side walls constituting a frame of the fixing device 50.

The heat generator support 23 supports the sheet heat generator 22 in such a manner that the sheet heat generator 22 contacts the inner circumferential surface of the fixing sleeve 21. Accordingly, the heat generator support 23 includes an arc-shaped outer circumferential surface having a predetermined circumferential length and disposed along the inner circumferential surface of the circular fixing sleeve 21 in cross-section.

The heat generator support 23 may have a heat resistance that resists heat generated by the sheet heat generator 22, a strength sufficient to support the sheet heat generator 22 without getting deformed by the fixing sleeve 21 when the rotating fixing sleeve 21 contacts the sheet heat generator 22, and sufficient heat insulation so that heat generated by the sheet heat generator 22 is not transmitted to the core holder 28 but which does transmit the heat to the fixing sleeve 21. For example, the heat generator support 23 may be a molded foam including polyimide resin.

When the sheet heat generator 22 is configured to contact the inner circumferential surface of the fixing sleeve 21, the rotating fixing sleeve 21 applies a force that pulls the sheet heat generator 22 to the nip to the sheet heat generator 22. To address this force, the heat generator support 23 may include the molded foam including polyimide resin that provides the heat generator support 23 with a strength sufficient to support the sheet heat generator 22 without being deformed. Alternatively, a supplemental solid resin member may be provided inside the molded foam including polyimide resin to improve rigidity.

Figure 3:
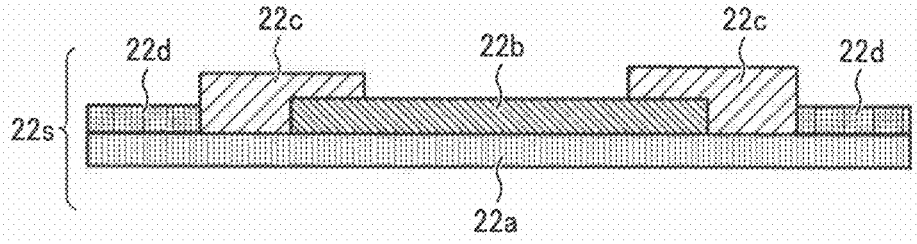
FIG. 3 is a schematic cross-sectional view of a heat generation sheet employed in the fixing device according to an illustrative embodiment of the present invention.

With reference to FIG. 3, a description is provided of the sheet heat generator 22. FIG. 3 is a schematic cross-sectional diagram illustrating the sheet heat generator 22. As illustrated in FIG. 3, the sheet heat generator 22 includes a heat generation sheet 22*s*. The heat generation sheet 22*s* includes a base layer 22*a* having insulation, a resistant heat generation layer 22*b* provided on the base layer 22*a* and including conductive particles dispersed in a heat-resistant resin, an electrode layer 22*c* provided on the base layer 22*a* to supply power to the resistant heat generation layer 22*b*, and an insulation layer 22*d* provided on the base layer 22*a*. The heat generation sheet 22*s* is flexible, and has a predetermined width in the axial direction of the fixing sleeve 21 depicted in FIG. 2 and a predetermined length in the circumferential direction of the fixing sleeve 21.

The insulation layer 22*d* insulates the resistant heat generation layer 22*b* from the adjacent electrode layer 22*c* of a different power supply system, and insulates an edge of the heat generation sheet.

The sheet heat generator 22 includes an electrode terminal 22*e* (see FIG. 6) to supply power supplied via the power supply wire 25 to the electrode layer 22*c*. An end portion of the sheet heat generator 22 is connected to the electrode layer 22*c*.

The heat generation sheet 22*s* has a thickness in a range of from about 0.1 mm to about 1.0 mm, and has a flexibility sufficient to wrap around the heat generator support 23 depicted in FIG. 3 at least along an outer circumferential surface of the heat generator support 23.

The base layer 22*a* is a thin, elastic film including a heat-resistant resin such as polyethylene terephthalate (PET) or polyimide resin. For example, the base layer 22*a* may be a film including polyimide resin to provide heat resistance, insulation, and a certain level of flexibility.

The resistant heat generation layer 22*b* is a thin, conductive film in which particles of conductive material such as carbon or metal are uniformly dispersed in a heat-resistant resin such as polyimide resin. When power is supplied to the resistant heat generation layer 22*b*, internal resistance of the resistant heat generation layer 22*b* generates Joule heat. The resistant heat generation layer 22*b* is manufactured by coating the base layer 22*a* with a coating compound in which conductive particles, such as carbon particles and metal particles, are dispersed in a precursor including a heat-resistant resin such as polyimide resin.

Alternatively, the resistant heat generation layer 22*b* may be manufactured by providing a thin conductive layer including carbon particles and/or metal particles on the base layer 22*a* and then providing a thin insulation film including a heat-resistant resin such as polyimide resin on the thin conductive layer. Thus, the thin insulation film is laminated on the thin conductive layer to integrate the thin insulation film with the thin conductive layer.

The carbon particles used in the resistant heat generation layer 22*b* may be known carbon black powder or carbon nanoparticles formed of at least one of carbon nanofiber, carbon nanotube, and carbon microcoil.

The metal particles used in the resistant heat generation layer 22*b* may be silver, aluminum, or nickel particles, and may be granular or filament-shaped.

The insulation layer 22*d* may be manufactured by coating the base layer 22*a* with an insulation material including a heat-resistant resin identical to the heat-resistant resin of the base layer 22*a*, such as polyimide resin.

The electrode layer 22*c* may be manufactured by coating the base layer 22*a* with a conductive ink or a conductive paste such as silver. Alternatively, metal foil or a metal mesh may be adhered to the base layer 22*a*.

The heat generation sheet 22*s* of the sheet heat generator 22 is a thin sheet having a small heat capacity, and thus heats quickly. An amount of heat generated by the heat generation sheet 22*s* is arbitrarily set according to the volume resistivity of the resistant heat generation layer 22*b*. In other words, the amount of heat generated by the heat generation sheet 22*s* can be adjusted at will according to the material, shape, size, and dispersion of conductive particles of the resistant heat generation layer 22*b*. For example, the sheet heat generator 22 providing heat generation per unit area of 35 W/cm$^2$ outputs a total power of about 1,200 W. In such a case, the heat generation sheet 22*s* has a width of about 20 cm in the axial direction of the fixing sleeve 21 and a length of about 2 cm in the circumferential direction of the fixing sleeve 21, for example.

If a metal filament, such as a stainless steel filament, is used as a sheet heat generator, the metal filament causes asperities to appear in the surface of the sheet heat generator. Consequently, when the inner circumferential surface of the fixing sleeve 21 slides over the sheet heat generator, the asperities of the sheet heat generator abrade the surface of the sheet heat generator easily.

To address this problem, according to this exemplary embodiment, the heat generation sheet 22*s* has a smooth surface without asperities as described above, providing improved durability in particular against wear due to sliding of the inner circumferential surface of the fixing sleeve 21 over the sheet heat generator 22. Further, a surface of the resistant heat generation layer 22*b* of the heat generation sheet 22*s* may be coated with fluorocarbon resin to further improve durability.

As described above, the heat generation sheet 22*s* is disposed contacting the inner circumferential surface of the fixing sleeve 21. Alternatively, the heat generation sheet 22*s* may be disposed arbitrarily in a region in the circumferential direction of the fixing sleeve 21 between a position on the fixing sleeve 21 opposite the nip and a position upstream from the nip.

As described above, in the fixing device 50, because the fixing sleeve 21 is pulled by the pressing roller 31 at the nip when rotating, tension acts on a portion of the fixing sleeve 21 upstream from the nip, causing the inner circumferential surface of the fixing sleeve 21 to contact slidably the sheet heat generator 22 while being pressed against the heat generator support 23. On the other hand, no tension acts on a portion of the fixing sleeve 21 downstream from the nip so that the fixing sleeve 21 is loose. When operating at high speed in this state, the degree of slack of the fixing sleeve 21 downstream from the nip is increased, thereby degrading stable rotation of the fixing sleeve 21.

Figure 4:
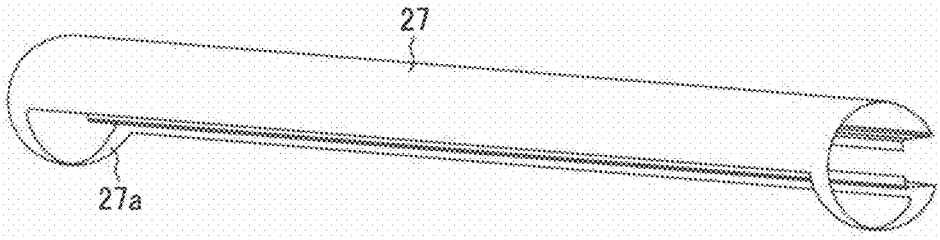
FIG. 4 is a schematic perspective view of a fixing member support employed in the fixing device.

To address this difficulty, the fixing device 50 may be provided with the fixing member support 27. With reference to FIG. 4, a detailed description is provided of the fixing member support 27. FIG. 4 illustrates a schematic perspective view of the fixing member support 27 employed in the fixing device 50.

The fixing member support 27 is made of pipe-shaped thin metal such as stainless steel and has a thickness in a range of from approximately 0.1 mm to 1 mm, for example. The outer diameter of the fixing member support 27 is smaller than the internal diameter of the fixing sleeve 21 by approximately 0.5 mm to 1 mm in diameter.

The inner circumferential surface of the fixing sleeve 21 contacts the outer circumferential surface of the fixing member support 27 between a position near the start of the nip and a position opposite the nip. The outer circumferential surface of the fixing member support 27 at the nip side is cut open along the axial direction thereof. The end portions of the cut portion are folded toward the core holder 28 so as not to touch the nip.

Figure 5A:
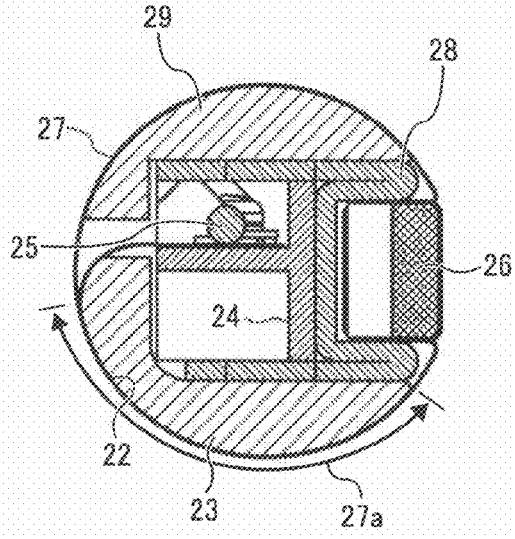
FIG. 5A is a schematic cross-sectional view of the fixing sleeve shown in FIGS. 2A and 2B.
Figure 5B:
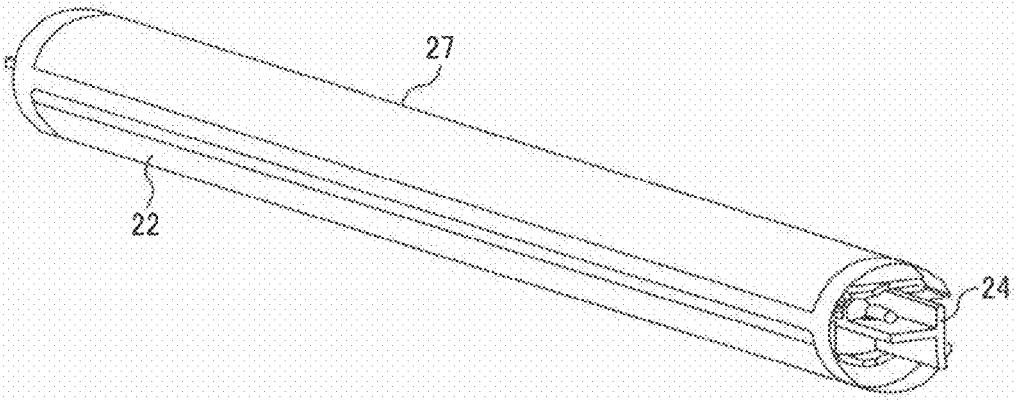
FIG. 5B is a perspective view of the fixing sleeve of FIG. 5A.

Furthermore, as illustrated in FIG. 4, a certain portion of the outer circumferential surface of the fixing member support 27 upstream from the nip is removed to form an opening 27*a*. With this configuration, as illustrated in FIG. 5A, when the internal components of the fixing sleeve 21 are installed, the entire surface of the sheet heat generator 22 is exposed from the opening 27*a*, and the front surface of the sheet heat generator 22 is on the same plane as the outer circumferential surface of the fixing member support 27. Alternatively, the surface of the sheet heat generator 22 projects slightly from the outer circumferential surface of the fixing member support 27. Accordingly, the sheet heat generator 22 (the sheet generation sheet 22*s*) supported by the heat generation support 23 contacts the inner circumferential surface of the fixing sleeve 21, thereby heating the fixing sleeve 21 effectively.

Furthermore, the fixing member support 27 not only secures stable rotation of the fixing sleeve 21, but also facilitates assembly of the fixing sleeve 21. Because the fixing member support 27 is made of rigid metal, the fixing sleeve 21 is supported securely by the fixing member support 27.

The heat insulation support 29 is heat-resistant and heat-insulating, and has sufficient strength. More particularly, the heat insulation support 29 withstands heat from the fixing sleeve 21 through the fixing member support 27 at the nip end, prevents heat loss of the fixing member support 27 contacting the fixing sleeve 21, and has enough strength to support the fixing member support 27 to prevent deformation thereof when contacting the rotating fixing sleeve 21. The heat insulation support 29 may be molded foam including polyimide resin similar to, if not the same resin, used in the heat generator support 23.

As described above, the fixing device 50 reduces warm-up time and first print time.

Rotation and vibration of the pressing roller 31 repeatedly applies mechanical stress to the heat generation sheet 22*s*, which bends the heat generation sheet 22*s*. The repeated bending of the heat generation sheet 22*s* causes fatigue failure. To counteract this difficulty, the heat generation sheet 22*s* of the sheet heat generator 22 is a resin-based sheet, thereby preventing fatigue failure and enabling reliable operation for an extended period of time.

In addition, the rotation support member 27 (and the heat insulation support 29 if necessary) improves stable rotation of the fixing sleeve 21, thereby enabling high-speed operation. The rotation support member 27 heats evenly the fixing sleeve 21 auxiliary in the axial direction thereof due to heat conductivity of the rotation support member 27 in the axial direction of the fixing sleeve 21, thereby facilitating high-speed operation.

With reference to FIGS. 6A and 6B, a description is now provided of a configuration of the sheet heat generator 22. FIG. 6A illustrates a plan view of the sheet heat generator 22 spread on a flat surface before the sheet heat generator 22 is adhered to the heat generation support 23. A horizontal direction in FIG. 6A corresponds to a width direction of the heat generation sheet 22*s* in the axial direction of the fixing sleeve 21. A vertical direction corresponds to the circumference of the fixing sleeve 21. FIG. 6B is a lookup table of a line-column matrix showing segmentation of the sheet heat generator 22.

In order to accommodate the recording media sheets in different sizes, the resistant heat generation layer 22*b* of the heat generation sheet 22*s* needs to be formed independently in each of a plurality of regions of the base layer 22*a* segmented in the axial direction so that the resistant heat layer 22*b* can generate heat independently in each of the segments.

As illustrated in FIG. 6A, the heat generation sheet 22*s* is divided into three regions in the width direction (the axial direction) and two in the length direction (the circumferential direction), thereby forming a total of six segmented regions. Each of the six segmented regions is indicated by a corresponding segment in the line-column matrix shown in FIG. 6B. In FIG. 6B, the direction of the length (the circumference direction) corresponds to a line component. The width direction (the axial direction) corresponds to a column component.

A resistant heat generation layer 22*b*1 having a predetermined width and length is provided in the element (1, 2) corresponding to the region at a lower center portion of the heat generation sheet 22*s* in FIG. 6A in the axial direction of the fixing sleeve 21. Resistant heat generation layers 22*b*2 having a predetermined width and length are provided in the elements (2, 1) and (2, 3) corresponding to the regions at upper lateral end portions of the heat generation sheet 22*s* in FIG. 6A in the axial direction of the fixing sleeve 21, respectively.

The electrode layers 22*c* connected to the resistant heat generation layer 22*b*1 are provided in the elements (1, 1) and (1, 3) corresponding to the regions provided at lower lateral end portions of the heat generation sheet 22*s* in FIG. 6A in the axial direction of the fixing sleeve 21, respectively. Each of the electrode layers 22*c* is connected to an electrode terminal 22*e*1 that protrudes from one edge, that is, a lower edge in FIG. 6A, of the heat generation sheet 22*s*, forming a first heat generation circuit.

The electrode layer 22*c* connected and sandwiched between the two resistant heat generation layers 22*b*2 is provided in the element (2, 2) corresponding to the region at an upper center portion of the heat generation sheet 22*s* in FIG. 6A in the axial direction of the fixing sleeve 21. Each of the two resistant heat generation layers 22*b*2 is connected to the electrode layer 22*c* that extends to the lower edge of the heat generation sheet 22*s* in FIG. 6A in the circumferential direction of the heat generation sheet 22*s*. Each of the electrode layers 22*c* is connected to the electrode terminal 22*e*2 that protrudes from the lower edge of the heat generation sheet 22*s*, forming a second heat generation circuit.

The insulation layer 22*d* is provided between the first heat generation circuit and the second heat generation circuit to prevent a short circuit of the first heat generation circuit and the second heat generation circuit.

In the sheet heat generator 22 having the above-described configuration, when the electrode terminals 22*e*1 supply power to the heat generation sheet 22*s*, internal resistance of the resistant heat generation layer 22*b*1 generates Joule heat. By contrast, the electrode layers 22*c* do not generate heat due to their low resistance. Accordingly, only the region of the heat generation sheet 22*s* shown by the element (1, 2) generates heat to heat the center portion of the fixing sleeve 21 in the axial direction of the fixing sleeve 21.

On the other hand, when the electrode terminals 22*e*2 supply power to the heat generation sheet 22*s*, internal resistance of the resistant heat generation layers 22*b*2 generates Joule heat. By contrast, the electrode layers 22*c* do not generate heat due to their low resistance. Accordingly, only the regions of the heat generation sheet 22*s* shown by the elements (2, 1) and (2, 3), respectively, generate heat to heat the lateral end portions of the fixing sleeve 21 in the axial direction of the fixing sleeve 21.

When a small size recording medium P having a narrow width passes through the fixing device 50, power is supplied to the electrode terminals 22*e*1 to heat only the center portion of the heat generation sheet 22*s* in the axial direction of the fixing sleeve 21. By contrast, when a large size recording medium P having a wide width passes through the fixing device 50, power is supplied to both electrode terminals 22*e*1 and 22*e*2 to heat the heat generation sheet 22*s* throughout the entire width thereof in the axial direction of the fixing sleeve 21. Thus, the fixing device 50 provides desired fixing according to the width of the recording medium P with reduced energy consumption.

Further, because the amount of heat generated by the sheet heat generator is adjusted in accordance with the size of the recording medium as described above, when printing small-size recording media sheets continuously, an amount of heat generated by the sheet heat generator 22 is adjusted in accordance with the size of the recording medium P. Accordingly, the lateral end portions of the sheet heat generator 22 corresponding to the portion of the fixing sleeve 21 over which the recording medium P is not conveyed, respectively, are not overheated, thus preventing stoppage of the fixing device 50 to protect the components of the fixing device 50 and decrease of productivity of the fixing device 50.

This configuration accommodates, for example, two different sizes of the recording medium. With reference to FIG. 7, a description is provided of a fixing device 20 capable of accommodating various sizes of recording media sheets, according to the illustrative embodiment of the present invention. FIG. 7 is a schematic cross-sectional view of the fixing device 20.

Similar to the fixing device 50 as described above, the fixing device 20 includes the endless rotatable fixing sleeve 21, the pressing roller 31 that contacts the outer circumferential surface of the fixing sleeve 21, the sheet heat generator 22, and the contact member 26 disposed inside the inner loop formed by the fixing sleeve 21 to contact the pressing roller 31 through the fixing sleeve 21 forming a nip. The fixing device 20 includes a contact adjuster 32.

The sheet heat generator 22 includes the heat generation sheet 22*s* having the predetermined width in the axial direction and the predetermined length in the circumference direction of the fixing sleeve 21. The sheet heat generator 22 includes the heat generation sheet 22*s* such that the heat generation sheet 22*s* is contactable against the inner circumferential surface of the fixing sleeve 21, while the heat generation sheet 22*s* remains flexible. The contact adjuster 32 adjusts the contact state of the fixing sleeve 21 and the heat generation sheet 22*s*.

It is to be noted that the fixing sleeve 21, the terminal stay 24, the power supply wire 25, the contact member 26, the fixing member support 27, the core holder 28, and the pressing roller 31 are similar to, if not the same as, that of the fixing device 20. The fixing device 50 need not include the heat generator support 23 as employed in the fixing device 20. Similarly, a heat insulation support similar to the heat insulation support 29 of the fixing device 20 may or may not be provided to the fixing device 50.

The sheet generation sheet 22*s* may be formed of a single sheet. It is to be noted that, in FIG. 7, reference numerals 22*s* and 22*s*' indicate two different states of the heat generation sheet 22*s*, in which the position of the heat generation sheet 22*s* is changed by the contact adjuster 32.

The heat generation sheet 22*s* has a similar, if not the same configuration as that of the heat generation sheet 22*s* illustrated in FIG. 3. The heat generation sheet 22*s* has a predetermined width corresponding to a maximum sheet (recording medium) passing area of the fixing sleeve 21 in the axial direction thereof and a predetermined length in the circumferential direction of the fixing sleeve 21.

A resistant heat generation layer similar to the resistant heat generation layer 22*b* shown in FIG. 3 is formed in a portion or an entire top surface of the base layer 22*a*. When power is supplied to the resistant heat generation layer by the electrode terminal 22*e*, the entire heat generation sheet 22*s* generates heat evenly.

According to the present embodiment, a difference in the heat generation sheet 22*s* of the sheet heat generator 22 compared to the heat generation sheet 22*s* in FIG. 3 is that the base layer 22*a* of the heat generation sheet 22*s* has a strength sufficient to retain the shape of the heat generation sheet 22*s*. For example, the base layer 22*a* is a mold sheet made of heat-resistant resin including, but not limited to, polyimide resin, heat-resistant PET resin, and liquid crystal polymer (LCP). The base layer 22*a* is curved along the inner circumferential surface of the fixing sleeve 21 having a circular shape in the circumferential direction, and is straight in the axial direction, which is referred to as a basic shape. Alternatively, the base layer 22*a* may be made of a metal plate having the basic shape with an insulating surface.

With this configuration, as long as no external force is applied, the shape of the heat generation sheet 22*s* is retained to have the basic shape of the base layer 22*a* even when the resistant heat generation layer generates heat.

By contrast, when an external force acts on the end portions of the heat generation sheet 22*s* supported at the center in the axial direction, the base layer 22*a* bends together with the resistant heat generation layer 22*b* and the electrode layer 22*c*. The heat generation sheet 22*s* is flexible to a certain degree.

The contact adjuster 32 supports the heat generation sheet 22*s* such that the heat generation sheet 22*s* contacts the fixing sleeve 21 at a first position (contact position) in the axial direction of the fixing sleeve 21. By contrast, the contact adjuster 32 enables the heat generation sheet 22*s* to separate from, approach, or contact to the inner circumferential surface of the fixing sleeve 21 at a second position (separation position) by bending the heat generation sheet 22*s*. Accordingly, the contact state of the fixing sleeve 21 and the heat generation sheet 22*s* is adjusted in the axial direction.

Figure 8A:
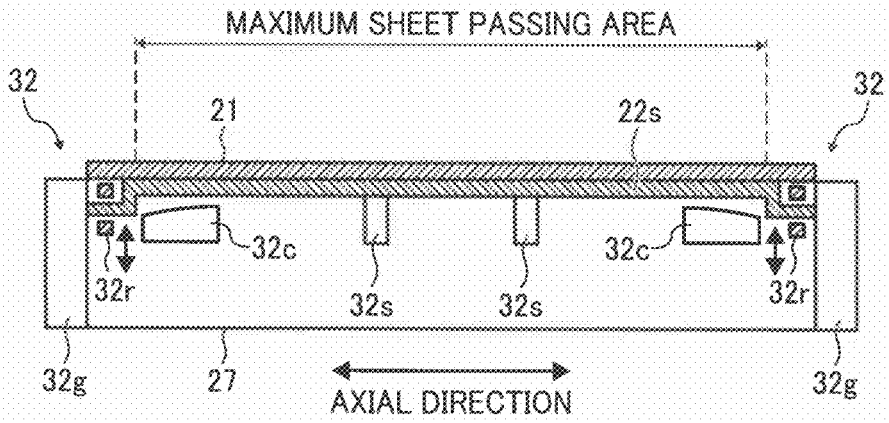
FIG. 8A is a schematic cross-sectional diagram illustrating an example of a contact adjuster employed in the fixing member support shown in FIG. 4, in which an entire surface of a heat generation sheet in an axial direction thereof is in contact with an inner circumferential surface of the fixing sleeve.
Figure 8B:
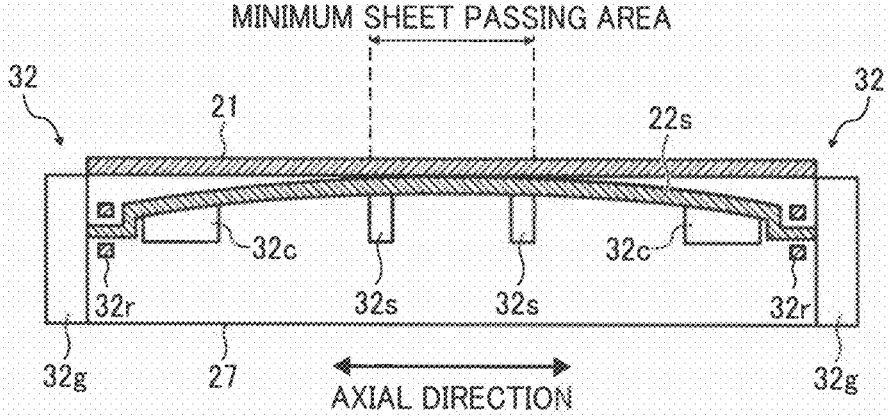
FIG. 8B is a schematic cross-sectional diagram illustrating the contact adjuster provided in the fixing member support, in which only a portion of the heat generation sheet is in contact with the inner circumferential surface of the fixing sleeve.
Figure 9A:
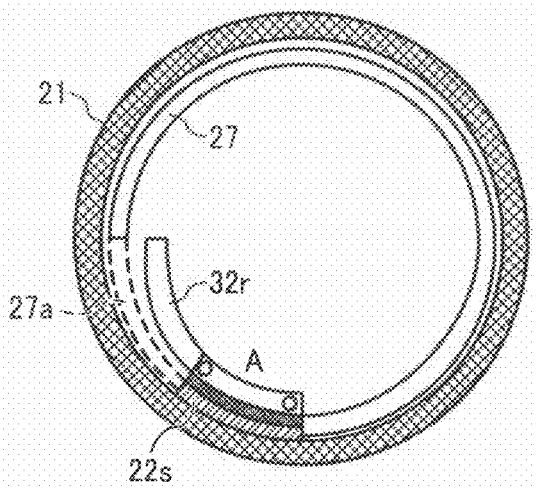
FIG. 9A is a schematic cross-sectional view of the contact adjuster and the heat generation sheet in the fixing member support when the heat generation sheet is at a position A.
Figure 9B:
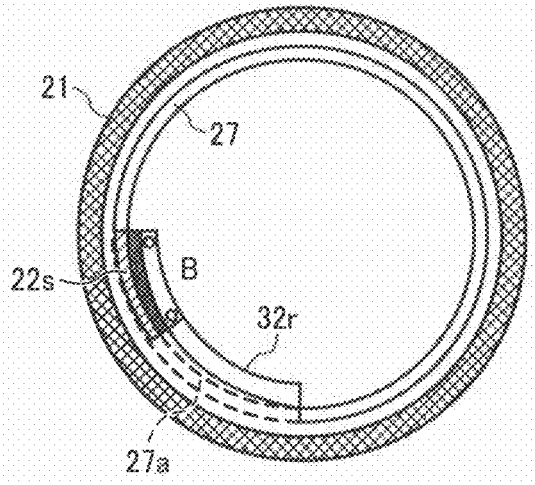
FIG. 9B is a schematic cross-sectional view of the contact adjuster and the heat generation sheet in the fixing member support when the heat generation sheet is at a position B.
Figure 10:
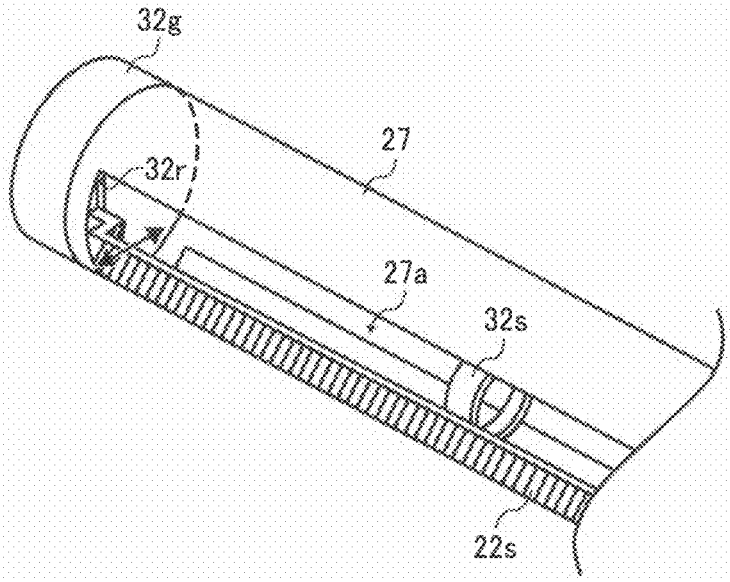
FIG. 10 is a schematic perspective view of the contact adjuster.

Referring to FIGS. 8 through 10, a description is provided of the contact adjuster 32. FIGS. 8A and 8B are schematic cross-sectional views of the contact adjuster 32 and the heat generation sheet 22*s* along the axial direction. FIGS. 9A and 9B are schematic cross-sectional diagrams of the contact adjuster 32 and the heat generation sheet 22*s*. FIG. 10 is a perspective view of the contact adjuster 32 and the fixing member support member 27.

As illustrated in FIG. 8A, the contact adjuster 32 includes two contact supports 32*s*, guide rails 32*r*, and drive transmitters 32*g* inside the fixing member support 27. The two contact supports 32*s* support the heat generation sheet 22*s* from the rear surface thereof at the first position (at a center) in the axial direction of the fixing sleeve 21 such that the heat generation sheet 22*s* contacts the fixing sleeve 21 in the circumference direction of the fixing member support 27 in cross section.

The guide rails 32*r* guide the heat generation sheet 22*s* such that the end portions of the heat generation sheet 22*s* are bent at the second position (end portions) in the axial direction of the fixing sleeve 21 as the heat generation sheet 22*s* moves in the circumferential direction.

The drive transmitters 32*g* are disposed outside the guide rails 32*r* in the axial direction and move the both end portions of the heat generation sheet 22*s* in the circumferential direction, thereby moving the entire heat generation sheet 22*s*.

Each of the contact supports 32*s* is disposed substantially at both ends of the minimum sheet passing area of the fixing sleeve 21, over which the recording medium is conveyed, to support the heat generation sheet 22*s* from the rear surface thereof to contact the fixing sleeve 21 in the minimum sheet passing area. It is to be noted that the minimum sheet passing area corresponds to, for example, a size of an A6-portrate recording medium having a width of approximately 105 mm.

More specifically, the contact supports 32*s* are fixed by the core holder 28. The surface of the heat generation sheet 22*s* protrudes from the opening 27*a* of the fixing member support 27. The surface of the heat generation sheet 22*s* corresponding to the minimum sheet passing area is on the same plane as the outer circumferential surface of the fixing member support 27. Alternatively, the surface of the heat generation sheet 22*s* corresponding to the minimum sheet passing area projects from the outer circumferential surface of the fixing member support 27. The heat generation sheet 22*s* is pressed against the inner circumferential surface of the fixing sleeve 21 at a certain pressure. The contact supports 32*s* may have insulating characteristics to prevent the contact supports 32*s* from absorbing heat when contacting the heat generation sheet 22*s*.

The drive transmitters 32*g* are disposed outside the walls of a housing of the fixing device 20 and transmit rotary driving force input externally to enable the end portions of the heat generation sheet 22*s* in the axial direction to move in the circumferential direction. The drive transmitters 32*g* include, for example, gear rails and gears that engage the gear rails. The gear rails may be provided outside each of the guide rails 32*r* in the axial direction and connect to the end portions of the heat generation sheet 22*s*. As the gear receives a rotary force from an external motor, the gear starts to rotate, thereby enabling the gear rails and the end portions of the heat generation sheet 22*s* in the axial direction to move in the circumferential direction.

With reference to FIGS. 9A and 9B, a description is provided of relative positions of the heat generation sheet 22*s* on the guide rail 32*r* and the fixing sleeve 21. In FIGS. 9A and 9B, the fixing sleeve 21, the heat generation sheet 22*s*, the fixing member support 27, and the guide rail 32*r* are depicted, and other components are omitted.

As illustrated in FIG. 9A, the guide rail 32*r* is an arc-shaped rail member that supports the heat generation sheet 22*s* such that the axial end portions of the heat generation sheet 22*s* are movable in the circumferential direction. The center of the arc is offset from the center of the axis of the fixing member support 27. That is, the center of the arc is not coaxial with respect to the center of the axis of the fixing member support 27.

The surface of the heat generation sheet 22*s* corresponding to the maximum sheet passing area generates heat. However, the end portions of the heat generation sheet 22*s* in the axial direction, that is, the portions where the guide rails 32*r* and the drive transmitter support, do not generate heat. It should be noted that the maximum sheet passing area refers to, for example, a size of an A4-landscape recording medium having a width of approximately 300 mm to 350 mm.

With this configuration, in accordance with the position of the heat generation sheet 22*s*, that is, the end portions in the axial direction on the guide rail 32*r*, a space, also referred to as a clearance, between the end portions of the heat generation sheet 22*s* in the axial direction and the inner circumferential surface of the fixing sleeve 21 is adjusted. The end portions of the heat generation sheet 22*s* are adjusted to contact or separate from the inner circumferential surface of the fixing sleeve 21.

The purpose of providing the space (clearance) between the end portions of the heat generation sheet 22 and the fixing sleeve 21 is to prevent heat of the heat generation sheet 22*s* from permeating to the fixing sleeve 21. A contact width of the heat generation sheet 22*s* and the inner circumferential surface of the fixing sleeve 21, that is, the width of the fixing sleeve 21 heated by the heat generation sheet 22*s* is adjusted by changing the space (clearance) provided between the end portions of the heat generation sheet 22*s* in the axial direction and the inner circumferential surface of the fixing sleeve 21.

As the drive transmitters 32*g* enable the end portions of the heat generation sheet 22*s* to move to a position A (closest to the upstream of the nip) on the guide rails 32*r* as illustrated in FIG. 9A, the surface of the end portions of the heat generation sheet 22*s* in the axial direction come to the same plane of the fixing member support 27 at the opening 27*a*, or projects slightly from the outer circumferential surface of the fixing member support 27. Accordingly, the surface of the heat generation sheet 22*s* contacts the inner circumferential surface of the fixing sleeve 21 at the predetermined pressure. With this configuration, the entire surface of the heat generation sheet 22*s* in the axial direction contacts the inner circumferential surface of the fixing sleeve 21 as illustrated in FIG. 8A, thereby heating the maximum sheet passing area of the fixing sleeve 21.

By contrast, as the drive transmitters 32*g* enable the end portions of the heat generation sheet 22*s* to move to a position B (farthest from the upstream of the nip) on the guide rail 32*r* as illustrated in FIG. 9B, the heat generation sheet 22*s* supported substantially at the center thereof by the support member 32*s* bends towards the axial center of the fixing member support 27, causing the heat generation sheet 22*s* to separate from the inner circumferential surface of the fixing sleeve 21. In this state, the heat generation sheet 22*s* is separated far from the inner circumferential surface of the fixing sleeve 21. With this configuration, the substantially center portion of the heat generation sheet 22*s* in the axial direction corresponding to the minimum sheet passing area contacts the inner circumferential surface of the fixing sleeve 21 as illustrated in FIG. 8B, thereby heating the minimum sheet passing area of the fixing sleeve 21. The end portions of the heat generation sheet 22*s* are bend by approximately 0.1 mm from the basic shape.

Furthermore, the drive transmitter 32*g* may move the end portions of the heat generation sheet 22*s* in the axial direction between the position A and the position B on the guide rail 32*r* along its curve. The heat generation sheet 22*s* may be supported at an arbitrary position between the position A and the position B.

For example, moving the end portions of the heat generation sheet 22*s* from the position A to the position B as illustrated in FIGS. 9A and 9B increases gradually an degree of bending of the end portions of the heat generation sheet 22*s* in the axial direction from the state in which the end portions of the heat generation sheet 22*s* are in contact with the inner circumferential surface of the fixing sleeve 21 at a predetermined pressure. As the degree of bending of the heat generation sheet 22*s* increases, the heat generation sheet 22*s* contacts the fixing sleeve 21 with little pressure and then separates from the fixing sleeve 21 altogether, all the while increasing the space (clearance) between the heat generation sheet 22*s* and the inner circumferential surface of the fixing sleeve 21 until reaching the position B, where the largest clearance is provided. With this configuration, the size of the clearance can be changed at will over a predetermined range.

Referring back to FIG. 8A, when contacting the inner circumferential surface of the fixing sleeve 21 at the position A at a certain pressure, the entire surface of the heat generation sheet 22*s* contacts the inner circumferential surface of the fixing sleeve 21, thereby heating the maximum sheet passing area of the fixing sleeve 21. Subsequently, the end portions of the heat generation sheet 22*s* in the axial direction thereof move from the position A to the position B, causing the end portions of the heat generation sheet 22*s* to separate from the fixing sleeve 21 and increasing gradually the clearance between the end portions of the heat generation sheet 22*s* and the inner circumferential surface the fixing sleeve 21.

By increasing the clearance between the end portions of the heat generation sheet 22*s* and the fixing sleeve 21, the width of the heat generation sheet 22*s* contacting the inner circumferential surface of the fixing sleeve 21 decreases gradually from the width of the maximum sheet passing area to the minimum sheet passing area. Ultimately, the width of contact is reduced to the minimum sheet passing area at the position B as illustrated in FIG. 8B.

The contact adjuster 32 adjusts an degree of bending of the heat generation sheet 22*s* at the second position, that is, at the end portions of the heat generation sheet 22*s* in the axial direction, in accordance with the width of the recording medium P passing through the nip. With this configuration, a desired clearance between the end portions of the heat generation sheet 22*s* in the axial direction and the inner circumferential surface of the fixing sleeve 21 is obtained. This means that the width of the heat generation sheet 22*s* contacting the fixing sleeve 21 is adjusted to correspond to the width of the recording medium P, thereby preventing the portions of the fixing sleeve 21 outside the width of the recording medium from getting overheated.

It is to be noted that when the end portions of the heat generation sheet 22*s* are bent and thus separated from the fixing sleeve 21, heat of the heat generation sheet 22 separated from the fixing sleeve 21 is not absorbed by the fixing sleeve 21. As a result, the heat generation sheet 22*s* may be overheated.

In view of this, a cooling member 32*c* is provided substantially at both ends portions of the rear side of the heat generation sheet 22*s* as illustrated in FIGS. 8A and 8B. As illustrated in FIG. 8B, the cooling members 32*c* contact the heat generation sheet 22*s* when the end portions of the heat generation sheet 22*s* are bent, thereby cooling at least a portion of the heat generation sheet 22*s*. The cooling members 32*c* may be made of a metal plate having good heat conductivity, for example.

The following describes operation of the fixing device 20 having the above-described structure.

When the image forming apparatus 1 receives an output signal, for example, when the image forming apparatus 1 receives a print request specified by a user by using a control panel or a print request sent from an external device, such as a personal computer, the pressing roller 31 is pressed against the contact member 26 via the fixing sleeve 21 to form the nip N between the pressing roller 31 and the fixing sleeve 21.

Thereafter, a driver drives and rotates the pressing roller 31 in a clockwise direction in FIG. 7. Accordingly, the fixing sleeve 21 rotates counterclockwise in FIG. 7 in accordance with rotation of the pressing roller 31. The contact adjuster 32 enables the sheet heat generator 22 to slidably contact the inner circumferential surface of the fixing sleeve 21 at the width corresponding to the width of the recording medium P passing through the nip.

Simultaneously, an external power source or an internal capacitor supplies power to the sheet heat generator 22 via the power supply wire 25 to cause the heat generation sheet 22*s* to generate heat. The heat generated by the heat generation sheet 22*s* is transmitted effectively to the fixing sleeve 21 contacting the heat generation sheet 22*s*, so that the fixing sleeve 21 is heated quickly.

Alternatively, heating of the fixing sleeve 21 by the sheet heat generator 22 may not start simultaneously with driving of the pressing roller 31 by the driver. In other words, the sheet heat generator 22 may start to heat the fixing sleeve 21 at a time different from a time at which the driver starts driving the pressing roller 31.

A temperature detector is provided at a position upstream from the nip N in the rotation direction of the fixing sleeve 21 with or without contacting the fixing sleeve 21. The temperature detector detects a temperature of the fixing sleeve 21 to control heat generation of the sheet heat generator 22 based on a detection result provided by the temperature detector so as to heat the nip N up to a predetermined fixing temperature. When the nip N is heated to the predetermined fixing temperature, the fixing temperature is maintained, and a recording medium P is conveyed to the nip N.

In the fixing device 20 according to the present embodiment, the fixing sleeve 21 and the sheet heat generator 22 have a small heat capacity, shortening a warm-up time and a first print time of the fixing device 20 while saving energy.

Further, the heat generation sheet 22*s* is a resin sheet. Accordingly, even when rotation and vibration of the pressing roller 31 apply undesirable stress to the heat generation sheet 22*s* repeatedly and bend the heat generation sheet 22*s* repeatedly, the heat generation sheet 22*s* does not break due to wear, and the fixing device 20 operates for a longer time. Still further, only a portion of the fixing sleeve 21 corresponding to the width of the recording medium P (sheet passing area) is heated, thereby preventing overheating of portions outside of the sheet passing area.

When the image forming apparatus 1 does not receive an output signal on the other hand, the pressing roller 31 and the fixing sleeve 21 do not rotate and power is not supplied to the sheet heat generator 22, to reduce power consumption. However, in order to restart the fixing device 20 immediately after the image forming apparatus 1 receives an output signal, power can be supplied to the sheet heat generator 22 while the pressing roller 31 and the fixing sleeve 21 do not rotate. For example, power in an amount sufficient to keep the entire fixing sleeve 21 warm is supplied to the sheet heat generator 22.

Figure 11:
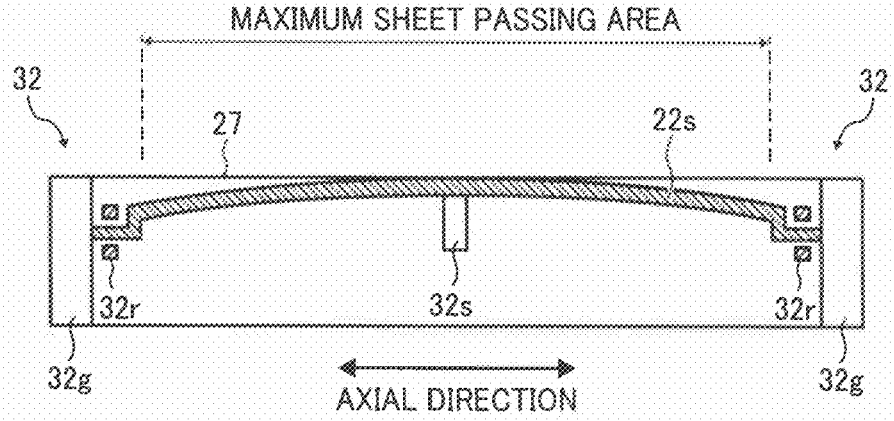
FIG. 11 is a schematic perspective view of a variation of the contact adjuster.
Figure 12:
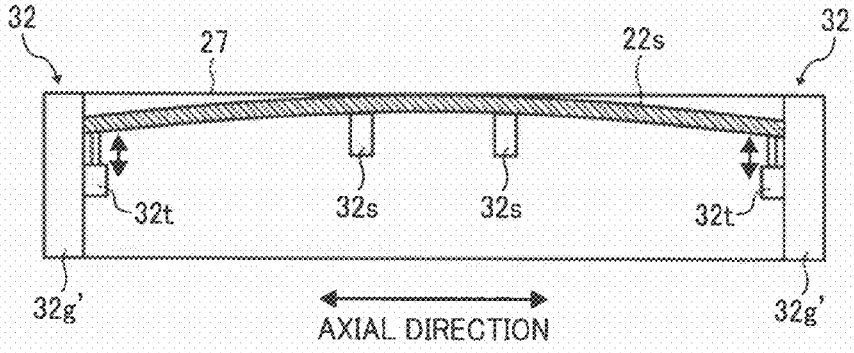
FIG. 12 is a schematic perspective view of another variation of the contact adjuster.
Figure 13:
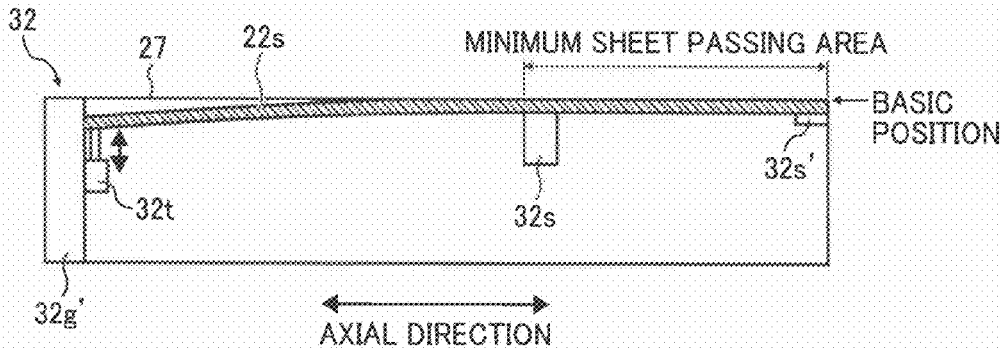
FIG. 13 is a schematic perspective view of a yet another variation of the contact adjuster.

The configuration of the contact adjuster 32 is not limited the contact adjuster illustrated in FIGS. 8 through 10. FIGS. 11 through 13 illustrate variations of the contact adjuster 32. FIG. 11 is a schematic cross-sectional view of a contact adjuster as one variation of the contact adjuster 32. FIG. 12 is a schematic cross-sectional view of a contact adjuster as another variation of the contact adjuster 32. FIG. 13 is a schematic cross-sectional view of a contact adjuster as yet another variation of the contact adjuster 32.

As illustrated in FIG. 11, one support member 32*s* is provided substantially at the center in the axial direction at the rear side of the heat generation sheet 22*s*, to support the heat generation sheet 22*s* at a single point. Alternatively, the support member 32*s* may have a width in the axial direction wide enough to support the entire minimum sheet passing area of the heat generation sheet 22*s*.

According to another variation of the contact adjuster 32, as illustrated in FIG. 12, the contact adjuster 32 includes pulling mechanisms 32*t*. The pulling mechanisms 32*t* are disposed inside the fixing member support 27 and connected to the end portions of the heat generation sheet 22*s* in the axial direction. Both end portions of the pulling mechanisms 32*t* receive a drive force from drive transmitters 32*g*', thereby pulling the end portions of the heat generation sheet 22*s*.

In this configuration, the pulling mechanisms 32*t* adjust the contact state of the heat generation sheet 22*s* relative to the fixing sleeve 21 in the axial direction. When receiving no drive force from the drive transmitters 32*g*', the pulling mechanisms 32*t* do not pull the end portions of the heat generation sheet 22*s*. In this state, the heat generation sheet 22*s* is held straight in the axial direction of the base layer 22*a* or held in the basic shape, and the entire surface of the heat generation sheet 22*s* in the axial direction contacts the inner circumferential surface of the fixing sleeve 21. That is, the maximum sheet passing area of the fixing sleeve 21 is heated.

By contrast, when receiving the drive force from the drive transmitters 32*g*', the pulling mechanisms 32*t* pull both end portions of the heat generation sheet 22*s* in the axial direction, thereby bending the heat generation sheet 22*s* towards the center in the axial direction relative to the support member 32*s* supporting the heat generation sheet 22*s*. Accordingly, both end potions of the heat generation sheet 22*s* in the axial direction separate from the inner circumferential surface of the fixing sleeve 21.

In this embodiment, an degree of bending of the heat generation sheet 22*s* increases proportionally to the amount of pull by the pulling mechanisms 32*t*. The degree of bending of the heat generation sheet 22*s* is adjusted by adjusting the amount of pull by the pulling mechanisms 32*t* at the end portions of the heat generation sheet 22*s* (the second position) in accordance with the width of the recording medium P passing in the nip. Accordingly, the desired distance between the end portions of the heat generation sheet 22*s* in the axial direction and the inner circumferential surface of the fixing sleeve 21 is obtained. The contact width of the heat generation sheet 22*s* and the inner circumferential surface of the fixing sleeve 21 are changed arbitrarily in a range from the minimum sheet passing area to the maximum sheet passing area, thereby also preventing overheating of the fixing sleeve 21 outside the width of the recording medium P.

In the contact adjuster 32 illustrated in FIGS. 11 and 12, the end portions of the heat generation sheet 22*s* in the basic shape in which the heat generation sheet 22 is held straight in the axial direction are bent towards the axial center of the fixing member support 27 to adjust the width of contact between the heat generation sheet 22*s* and the inner circumferential surface of the fixing sleeve 21. The configuration of the contact adjuster 32 is not limited to the foregoing embodiments described above.

With reference to FIG. 13, a description is provided of yet another variation of the contact adjuster 32. In this configuration, one end of the heat generation sheet 22*s* is fixed by a stationary member 32*s*' and other end of the heat generation sheet 22*s* is bent.

More specifically, the stationary member 32*s*' holds one end of the heat generation sheet 32 in the axial direction (for example, the right end portion in FIG. 13, the first position) such that the one end portion of the heat generation sheet 22*s* contacts the inner circumferential surface of the fixing sleeve 21 at the opening 27*a* of the fixing member support 27 always at a predetermined pressure. The support member 32*s* supports the minimum sheet passing area of the heat generation sheet 22*s*, that is, from the end portion of the heat generation sheet 22*s* held by the stationary member 32*s*' to the center in the axial direction. The drive transmitter 32*g*' is provided to transmit the drive force input from an external device. The pulling mechanism 32*t* is disposed inside the fixing member support 27 and connected to the other end of the heat generation sheet 22*s* (the left end portion in FIG. 13) to pull the heat generation sheet 22*s*. The pulling mechanism 32*t* receives the drive force of the drive transmitter 32*g*'.

The contact adjuster 32 according to the present embodiment adjusts the position of the heat generation sheet 22*s* contacting the fixing sleeve 21 in the axial direction as follows. When receiving no drive force from the drive transmitter 32*g*', the pulling mechanism 32*t* does not pull the end portion of the heat generation sheet 22*s* connected to the pulling mechanism 32*t*. In this state, the heat generation sheet 22*s* is held straight in the axial direction of the base layer 22*a* or held in the basic shape, and the entire surface of the heat generation sheet 22*s* in the axial direction is in contact with the inner circumferential surface of the fixing sleeve 21. That is, the maximum sheet passing area of the fixing sleeve 21 is heated.

By contrast, when receiving the drive force from the drive transmitters 32*g*', the pulling mechanisms 32*t* pulls one end of the heat generation sheet 22*s* in the axial direction, thereby bending the heat generation sheet 22*s* towards the center in the axial direction relative to the support member 32*s* supporting the heat generation sheet 22*s*. Accordingly, one end portion of the heat generation sheet 22*s* in the axial direction separates from the inner circumferential surface of the fixing sleeve 21.

In the present embodiment, the degree of bending of the heat generation sheet 22*s* increases proportionally to the amount of pull by the pulling mechanisms 32*t*. The degree of bending of the heat generation sheet 22*s* is adjusted by adjusting the amount of pull by the pulling mechanisms 32*t* at the end portion of the heat generation sheet 22*s* (the second position) in accordance with the width of the recording medium P passing through the nip.

Accordingly, the desired distance between the end portion of the heat generation sheet 22*s* in the axial direction and the inner circumferential surface of the fixing sleeve 21 is obtained. The contact width of the heat generation sheet 22*s* and the inner circumferential surface of the fixing sleeve 21 is changed arbitrarily in a range from the minimum sheet passing area to the maximum sheet passing area, thereby also preventing overheating of the fixing sleeve 21 outside the width of the recording medium P.

In yet another variation of the contact adjuster 32, both end portions of the heat generation sheet 22*s* may be bent in advance as a basic shape, and the portion of the heat generation sheet 22*s* corresponding to the minimum sheet passing area substantially at the center in the axial direction may be flat. In this case, the contact adjuster 32 supports the heat generation sheet 22*s* contacting the fixing sleeve 21 at the first position (at the center) in the axial direction of the fixing sleeve 21. The both ends of the heat generation sheet 22*s* are bent at the second position (at both ends), enabling the heat generation sheet 22*s* to separate from, approach or contact the fixing sleeve 21. Accordingly, the contact state of the fixing sleeve 21 and the heat generation sheet 22*s* in the axial direction of the fixing sleeve 21 is adjusted.

According to the foregoing embodiments, the base layer 22*a* has a strength sufficient to support the heat generation sheet 22*s* in a predetermined shape. However, the base layer 22*a* is not limited to this.

Figure 14:
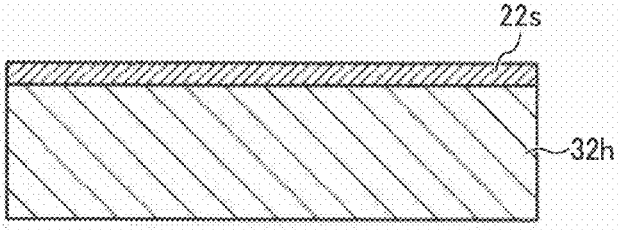
FIG. 14 is a schematic cross-sectional view of the heat generation sheet attached to a heat generation member retainer.

With reference to FIG. 14, a description is provided of one variation of the heat generation sheet 22*s*. FIG. 14 is a schematic cross-sectional view of the heat generation sheet 22*s* attached to the heat generation member retainer 32*h*. As illustrated in FIG. 14, the heat generation sheet 22*s* may be attached to the heat generation member retainer 32*h* shaped in a desired shape in advance, to keep the shape of the heat generation sheet 22*s*. The heat generation member retainer 32*h* may bend together with the heat generation sheet 22*s* at the second position.

The heat generation member retainer 32*h* is rigid enough to keep the shape of the heat generation sheet 22*s* when the heat generation member retainer 32*h* and the heat generation sheet 22*s* are attached to the contact adjuster 32. In the meantime, the heat generation member retainer 32*h* is flexible enough to bend when applied with an external force at the end portions in the axial direction.

For example, the heat generation member retainer 32*h* is a mold sheet made of heat-resistant resin including, but not limited to, polyimide resin, heat-resistant PET resin, and liquid crystal polymer (LCP). The heat generation member retainer 32*h* is curved along the inner circumferential surface of the fixing sleeve 21 having a circular shape in the circumferential direction, and is straight in the axial direction, which is referred to as a basic shape. Alternatively, the heat generation member retainer 32*h* is made of a metal plate having the basic shape.

The heat generation sheet 22*s* has a thickness in a range from approximately 0.1 to 1 mm and has flexibility sufficient to be attached to the heat generation member retainer 32*h* along its shape.

With this configuration, the basic shape of the heat generation sheet 22*s* is retained in accordance with the basic shape of the heat generation retainer 32*h* when the resistant heat generation layer 22*b* generates heat and there is no external force. By contrast, when an external force acts on the second position (at the end portions) of the heat generation sheet 22*s* while the heat generation sheet 22*s* is held at the first position (at the center), the heat generation sheet 22*s* slightly bends. This configuration provides effects equivalent to the effects provided by the foregoing embodiments.

In the fixing device 20, the pressing roller 31 is used as a pressing member. Alternatively, a pressing belt, a pressing pad, or a pressing plate may be used as a pressing member to provide effects equivalent to the effects provided by the pressing roller 31.

Further, the fixing sleeve 21 is used as a fixing member. Alternatively, an endless fixing belt or an endless fixing film may be used as a fixing member.

Figure 15:
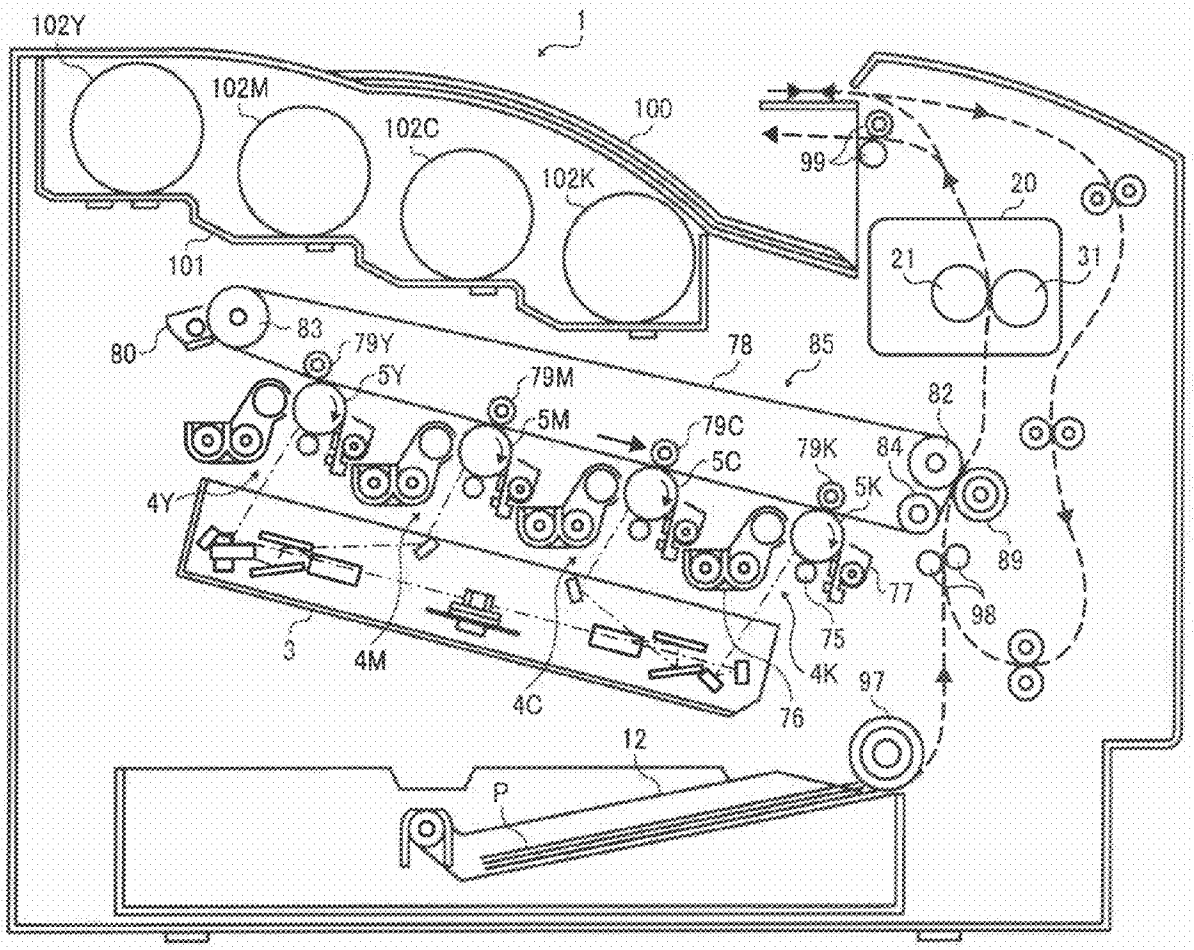
FIG. 15 is a schematic diagram illustrating an image forming apparatus according to an illustrative embodiment of the present invention.

With reference to FIG. 15, a description is provided of an image forming apparatus which employs the fixing device 20 according to the illustrative embodiment of the present invention. FIG. 15 is a schematic diagram illustrating the image forming apparatus 1. As illustrated in FIG. 15, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium.

As illustrated in FIG. 15, the image forming apparatus 1 includes an exposure device 3, image forming devices 4Y, 4M, 4C, and 4K, a paper tray 12, a fixing device 20, an intermediate transfer unit 85, a secondary transfer roller 89, a sheet feed roller 97, a registration roller pair 98, an sheet discharge roller pair 99, a stack portion 100, and a toner bottle holder 101.

The image forming devices 4Y, 4M, 4C, and 4K include photoconductive drums 5Y, 5M, 5C, and 5K, charging devices 75, development devices 76, and cleaners 77, respectively.

The fixing device 20 includes a fixing sleeve 21 and a pressing roller 31.

The intermediate transfer unit 85 includes an intermediate transfer belt 78, primary transfer bias rollers 79Y, 79M, 79C, and 79K, an intermediate transfer cleaner 80, a secondary transfer backup roller 82, a cleaner backup roller 83, and a tension roller 84.

The toner bottle holder 101 includes toner bottles 102Y, 102M, 102C, and 102K.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided substantially below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the charging devices 75, the development devices 76, the cleaners 77, and discharging devices are disposed around the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K in the clockwise direction in FIG. 15. In the charging process, each of the respective charging devices 75 uniformly charges surfaces of the photoconductive drums 5Y, 5M, 5C, and 5K at charging positions at which the charging devices 75 are disposed opposite the photoconductive drums 5Y, 5M, 5C, and 5K, respectively.

In the exposure process, the exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, each of the respective development devices 76 renders the electrostatic latent images formed on the surfaces of the photoconductive drums 5Y, 5M, 5C, and 5K visible as yellow, magenta, cyan, and black toner images at development positions at which the development devices 76 are disposed opposite the photoconductive drums 5Y, 5M, 5C, and 5K, respectively.

In the primary transfer process, the primary transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at primary transfer positions at which the primary transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in each of the respective cleaners 77 mechanically collect the residual toner from the photoconductive drums 5Y, 5M, 5C, and 5K at cleaning positions at which the cleaners 77 are disposed opposite the photoconductive drums 5Y, 5M, 5C, and 5K, respectively.

Finally, charge erasers remove residual potential on the photoconductive drums 5Y, 5M, 5C, and 5K at discharging positions at which the charge erasers are disposed opposite the photoconductive drums 5Y, 5M, 5C, and 5K, respectively, thus completing a sequence of image forming processes performed on the photoconductive drums 5Y, 5M, 5C, and 5K.

The intermediate transfer belt 78 is wound around and stretched between three rollers, which are the secondary transfer backup roller 82, the cleaning backup roller 83, and the tension roller 84. A single roller, that is, the secondary transfer backup roller 82, drives and endlessly moves (e.g., rotates) the intermediate transfer belt 78 in the counterclockwise direction indicated by an arrow in FIG. 15.

The four primary transfer bias rollers 79Y, 79M, 79C, and 79K and the photoconductive drums 5Y, 5M, 5C, and 5K sandwich the intermediate transfer belt 78 to form primary transfer nips, respectively. The primary transfer bias rollers 79Y, 79M, 79C, and 79K are applied with a transfer bias having a polarity opposite a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the rotating intermediate transfer belt 78 successively at the primary transfer nips formed between the photoconductive drums 5Y, 5M, 5C, and 5K and the intermediate transfer belt 78 as the intermediate transfer belt 78 moves through the primary transfer nips. Thus, a color toner image is formed on the intermediate transfer belt 78.

The paper tray 12 is provided in a lower portion of the image forming apparatus 1, and loads a plurality of recording media sheets P (e.g., transfer sheets). The sheet feed roller 97 rotates in the counterclockwise direction in FIG. 15 to feed an uppermost recording medium P of the plurality of recording media sheets P loaded on the paper tray 12 toward a roller nip formed between two rollers of the registration roller pair 98.

The registration roller pair 98, which stops to rotate temporarily, stops the uppermost recording medium P fed by the sheet feed roller 97 and reaching the registration roller pair 98. For example, the roller nip of the registration roller pair 98 contacts and stops a leading edge of the recording medium P. The registration roller pair 98 resumes rotating to feed the recording medium P to a secondary transfer nip, formed between the secondary transfer roller 89 and the intermediate transfer belt 78, as the color toner image formed on the intermediate transfer belt 78 reaches the secondary transfer nip.

At the secondary transfer nip, the secondary transfer roller 89 and the secondary transfer backup roller 82 sandwich the intermediate transfer belt 78. The secondary transfer roller 89 transfers the color toner image formed on the intermediate transfer belt 78 onto the recording medium P fed by the registration roller pair 98 at the secondary transfer nip formed between the secondary transfer roller 89 and the intermediate transfer belt 78. Thus, the desired color toner image is formed on the recording medium P. After the transfer of the color toner image, residual toner, which has not been transferred onto the recording medium P, remains on the intermediate transfer belt 78.

The intermediate transfer cleaner 80 collects the residual toner from the intermediate transfer belt 78 at a cleaning position at which the intermediate transfer cleaner 80 is disposed opposite the intermediate transfer belt 78, thus completing a single sequence of transfer processes performed on the intermediate transfer belt 78.

The recording medium P bearing the color toner image is sent to the fixing device 20. In the fixing device 20, the fixing sleeve 21 and the pressing roller 31 apply heat and pressure to the recording medium P to fix the color toner image on the recording medium P.

Thereafter, the fixing device 20 feeds the recording medium P bearing the fixed color toner image toward the sheet discharge roller pair 99. The sheet discharge roller pair 99 discharges the recording medium P to an outside of the image forming apparatus 1, that is, the stack portion 100. Thus, the recording media sheets P discharged by the sheet discharge roller pair 99 are stacked on the stack portion 100 successively to complete a single sequence of image forming processes performed by the image forming apparatus 1.

According to the illustrative embodiment, the present invention is employed in the image forming apparatus. The image forming apparatus includes, but is not limited to, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device for fixing a toner image on a recording medium, comprising:

an endless belt-shaped fixing member to rotate in a predetermined direction of rotation, formed in a loop;

a pressing member to contact an outer circumferential surface of the fixing member;

a contact member provided inside the loop formed by the fixing member and pressed against the pressing member via the fixing member to form a nip between the pressing member and the fixing member through which the recording medium bearing the toner image passes;

a sheet heat generator provided inside the loop formed by the fixing member and including a flexible heat generation sheet having a predetermined length in a circumferential direction of the fixing member and a width in an axial direction of the fixing member, contactable against the fixing member to heat the fixing member; and a contact adjuster provided inside the loop formed by the fixing member, to adjust an extent of contact of the heat generation sheet and the fixing member in the axial direction, the contact adjuster supporting the heat generation sheet at a first position at which the heat generation sheet contacts the fixing member and bending a portion of the heat generation sheet at a second position at which a portion of the heat generation sheet is separated from or contacts the fixing member.

2. The fixing device according to claim 1, wherein the first position coincides with substantially a center of the fixing member in the axial direction thereof, and the second position coincides with substantially an end portion of the fixing member.

3. The fixing device according to claim 1, wherein the contact adjuster adjusts a degree of bending of the heat generation sheet at the second position to match the extent of contact of the heat generation sheet against the fixing member with the width of the recording medium.

4. The fixing device according to claim 1, further comprising a cooling device provided inside the loop formed by the fixing member, to cool the heat generation sheet, wherein the heat generation sheet contacts the cooling device when the heat generation sheet separates from the fixing member at the second position.

5. The fixing device according to claim 1, wherein the heat generation sheet comprises an insulating base layer, a resistant heat generation layer provided on the base layer to generate heat and including conductive particles dispersed in a heat resistant resin, and an electrode layer provided on the base layer to supply power to the resistant heat generation layer.

6. The fixing device according to claim 5, wherein the base layer retains the heat generation sheet in a predetermined shape, and the base layer bends together with the resistant heat generation layer and the electrode layer at the second position.

7. The fixing device according to claim 1, further comprising a base member having a predetermined shape, wherein the heat generation sheet is attached to the base member and retains its shape, and bends together with the base member at the second position.

8. The fixing device according to claim 1, further comprising a fixing member support provided inside the loop formed by the fixing member and downstream from the nip in the direction of rotation of the fixing member, to support the rotating fixing member.

9. The fixing device according to claim 1, wherein the contact adjuster includes arc-shaped guide rails provided at the second position, to bend both end portions of the heat generation sheet at the second position while the heat generation sheet moves in the circumferential direction.

10. The fixing device according to claim 1, wherein the contact adjuster includes a contact support provided substantially at the first position on a rear side of the heat generation sheet, to support the heat generation sheet against the fixing member across an area corresponding to a minimum recording medium passing area.

11. The fixing device according to claim 1, wherein the contact adjuster includes a pulling mechanism provided substantially at the second position, to pull the end portions of the heat generation sheet away from the fixing member.

12. An image forming apparatus, comprising the fixing device according to claim 1.

* * * * *